US006857296B2

(12) United States Patent
Fagg et al.

(10) Patent No.: US 6,857,296 B2
(45) Date of Patent: Feb. 22, 2005

(54) FABRIC BAG FOR USE IN FABRIC CARE PROCESSES

(75) Inventors: Andrew John Fagg, Brussels (BE); Steven Barrett Rogers, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 288 days.

(21) Appl. No.: 09/813,252

(22) Filed: Mar. 25, 2002

(65) Prior Publication Data

US 2004/0038842 A1 Feb. 26, 2004

Related U.S. Application Data

(60) Provisional application No. 60/190,640, filed on Mar. 20, 2000.

(51) Int. Cl.[7] ..... D06F 43/00

(52) U.S. Cl. ..... 68/235; 8/158; 8/137

(58) Field of Search ..... 8/158, 159, 142; 510/439; 68/17 R, 207; 34/329, 335, 353

(56) References Cited

U.S. PATENT DOCUMENTS

| | | | | |
|---|---|---|---|---|
| 1,538,022 | A | | 5/1925 | Brekke et al. |
| 1,616,572 | A | | 3/1927 | Conway et al. |
| 1,747,324 | A | | 2/1930 | Savitt |
| D189,342 | S | | 11/1960 | Lucchino et al. |
| D205,489 | S | | 8/1966 | Nagy et al. |
| 3,422,867 | A | | 1/1969 | Wu |
| D213,580 | S | | 3/1969 | Osborne et al. |
| D215,343 | S | | 9/1969 | Christie et al. |
| D269,646 | S | | 7/1983 | Schaer et al. |
| 4,630,312 | A | | 12/1986 | Milstein |
| 4,944,604 | A | | 7/1990 | Myklebust et al. |
| 4,974,967 | A | | 12/1990 | Tsuyoshi et al. |
| 5,238,587 | A | * | 8/1993 | Smith et al. ..... 510/277 |
| D340,963 | S | | 11/1993 | Hall et al. |
| D348,754 | S | | 7/1994 | Feller et al. |
| D363,254 | S | | 10/1995 | McGranaghan et al. |
| 5,540,501 | A | | 7/1996 | Franco et al. |
| 5,658,651 | A | * | 8/1997 | Smith et al. ..... 442/59 |
| D383,265 | S | | 9/1997 | Gable et al. |
| 5,746,776 | A | * | 5/1998 | Smith et al. ..... 8/142 |
| 5,762,648 | A | | 6/1998 | Yeazell |
| 5,770,284 | A | | 6/1998 | Logemann et al. |
| 5,804,548 | A | * | 9/1998 | Davis ..... 510/439 |
| 5,865,851 | A | * | 2/1999 | Sidoti et al. ..... 8/142 |
| D411,671 | S | | 6/1999 | Hamblin et al. |
| 5,951,716 | A | * | 9/1999 | Lucia, III et al. ..... 8/142 |
| 6,013,614 | A | * | 1/2000 | Mahdessian ..... 510/277 |
| 6,024,767 | A | * | 2/2000 | Telesca et al. ..... 8/142 |
| 6,036,727 | A | * | 3/2000 | Smith ..... 8/142 |
| 6,132,474 | A | * | 10/2000 | Smith et al. ..... 8/142 |
| 6,190,420 | B1 | * | 2/2001 | Reynolds ..... 8/142 |
| D452,353 | S | | 12/2001 | Wise et al. |
| 6,381,870 | B1 | | 5/2002 | Kohlman et al. |
| 2002/0112365 | A1 | | 8/2002 | Kohlman et al. |

FOREIGN PATENT DOCUMENTS

| | | | |
|---|---|---|---|
| GB | 2302553 A | | 1/1997 |
| JP | 4-3130473 | * | 6/1991 |
| WO | WO 97/27354 A1 | | 7/1997 |
| WO | WO 97/41291 A1 | | 11/1997 |
| WO | WO 00/37733 A1 | | 6/2000 |
| WO | WO 00/37733 | | 6/2000 |
| WO | WO 01/71088 | | 1/2002 |

* cited by examiner

*Primary Examiner*—Frankie L. Stinson
(74) *Attorney, Agent, or Firm*—Mark A. Charles; C. Brant Cook; Brahm J. Corstanje

(57) ABSTRACT

The present invention relates to improved bag-type containers for use in a non-immersion fabric care process for dry clean only fabrics. The outer shell of the bags are made from fabric such that the bags resist melting at higher temperatures than conventional non-fabric plastic bags and/or the bags are more pliable and/or supple than conventional non-fabric plastic bags and/or the bags retain more of their pliability and/or suppleness than conventional non-fabric plastic bags after being subjected to heat and/or the bags produce less noise during use than the conventional non-fabric plastic bags and/or the bags retain their shape and/or resist wrinkling during use better than the conventional non-fabric plastic bags. The bags of this invention are used in fabric care or "refreshment" processes are conducted in a hot air environment, preferably dryers, in the presence of a cleaning/refreshment composition.

18 Claims, 6 Drawing Sheets

FABRIC BAG FOR USE IN FABRIC CARE PROCESSES

CROSS REFERENCE TO RELATED APPLICATIONS

This application claims priority under 37 U.S.C. § 119(e) to U.S. Provisional Application Ser. No. 60/190,640, filed Mar. 20, 2000.

FIELD OF THE INVENTION

The present invention relates to fabric bag-type containers for use in a non-immersion fabric care process for dry clean only fabrics. The outer shell of the bags are made from fabric such that the bags resist melting at higher temperatures than conventional non-fabric plastic bags and/or the bags are more pliable and/or supple than conventional non-fabric plastic bags and/or the bags retain more of their pliability and/or suppleness than conventional non-fabric plastic bags after being subjected to heat and/or the bags produce less noise during use than the conventional non-fabric plastic bags and/or the bags retain their shape and/or resist wrinkling during use better than the conventional non-fabric plastic bags. The bags of this invention are used in fabric care or "refreshment" processes are conducted in a hot air environment, preferably dryers, in the presence of a cleaning/refreshment composition.

BACKGROUND OF THE INVENTION

Certain delicate fabrics are not suitable for conventional in-home immersion cleaning processes. Home washing machines, which provide excellent cleaning results for the majority of fabrics used in today's society, can, under certain conditions, shrink or otherwise damage silk, linen, wool and other delicate fabrics. Consumers typically have their delicate fabric items "dry-cleaned". Unfortunately, dry-cleaning usually involves immersing the fabrics in various hydrocarbon and halocarbon solvents that require special handling and must be reclaimed, making the process unsuitable for in-home use. Hence, dry-cleaning has traditionally been restricted to commercial establishments making it less convenient and more costly than in-home laundering processes. But, excluding cost and convenience, dry-cleaning processes remain generally superior to in-home, immersion laundering processes for the care of fine fabrics.

Attempts have been made to provide in-home dry-cleaning systems that combine the fabric cleaning and refreshing of in-home, immersion laundering processes with the fabric care benefits of dry-cleaning processes. One such in-home system for cleaning and refreshing garments comprises a substrate sheet containing various liquid or gelled cleaning agents, and a non-fabric plastic bag. The garments are placed in the bag together with the sheet, and then tumbled in a conventional clothes dryer. However, due to the properties of the non-fabric plastic bag, this in-home system is not suitable for hot or high heat dryers nor is it suitable for most conventional laundromat dryers which operate at higher temperatures than most in-home conventional dryers.

Further, conventional non-fabric plastic bags tend to lose their shape and/or become wrinkled during use in dryers.

Further yet, conventional non-fabric plastic bags are relatively rigid and/or tend to lose their pliability during use in dryers.

Still further yet, conventional non-fabric plastic bags tend to be relatively noisy during filling of the bag with garment (s) and/or during use in dryers and/or after being subjected to heat.

Accordingly, there is a need for a fabric care containment bag that is suitable for use in in-home dry-cleaning processes and/or laundromat dry-cleaning processes which resists melting at higher temperatures than conventional fabric care containment bags; namely, non-fabric plastic fabric care containment bags; a fabric care containment bag that is more pliable and/or supple than conventional non-fabric plastic fabric care containment bags; a fabric care containment bag that retains more of its pliability and/or suppleness than conventional non-fabric plastic fabric care containment bags after being subjected to heat; a fabric care containment bag that produces less noise during use than the conventional non-fabric plastic fabric care containment bags; a fabric care containment bag that retains its shape and/or resists wrinkling during use better than the conventional non-fabric plastic fabric care containment bags; and a fabric care kit comprising such a fabric care containment bag.

SUMMARY OF THE INVENTION

The present invention fulfills the needs identified above by providing a fabric bag that can be used in in-home and laundromat (commercial) dry-cleaning processes, especially when a hot or high heat dryer is used.

It has been surprisingly found that fabric bags, especially polyester bags, more preferably woven polyethylene terephthalate fabric bags provide improved performance over non-fabric plastic bags, as detailed below.

In one aspect of the present invention, a fabric containment bag that is heat resistant up to at least 230° C., preferably 240° C., more preferably 250° C. is provided.

In another aspect of the present invention, a fabric containment bag that is more pliable and/or supple than conventional non-fabric plastic fabric care containment bags is provided.

In yet another aspect of the present invention, a fabric containment bag that retains more of its pliability and/or suppleness than conventional non-fabric plastic fabric care containment bags after being subjected to heat is provided.

In still yet another aspect of the present invention, a fabric containment bag that produces less noise during use than the conventional non-fabric plastic fabric care containment bags is provided.

In still yet another aspect of the present invention, a fabric containment bag that retains its shape and/or resists wrinkling during use better than the conventional non-fabric plastic fabric care containment bags is provided.

In still yet another aspect of the present invention, a fabric care containment bag that substantially resists degradation (i.e., closure failure, fabric damage, damage to bag, such as holes, tears, seam damage, etc.) for at least 50 uses, preferably at least 75 uses, more preferably at least 100 uses.

In still yet another aspect of the present invention, a kit for cleaning and/or refreshing fabrics comprising a fabric containment bag in accordance with the present invention and a stain removing system comprising an absorbent stain receiving article and/or a stain removing composition in accordance with the present invention, and optionally instructions for using the fabric containment bag and stain removing system to clean and/or refresh a fabric article, is provided.

In still yet another aspect of the present invention, a kit for cleaning and/or refreshing fabrics comprising a fabric containment bag in accordance with the present invention and a cleaning and/or refreshing composition in accordance with the present invention and optionally instructions for using the fabric containment bag and cleaning and/or refreshing composition to clean and/or refresh a fabric article, is provided.

In still yet another aspect of the present invention, a kit for cleaning and/or refreshing a fabric article in need of cleaning and/or refreshing comprising a fabric containment bag in accordance with the present invention, and one or more absorbent articles comprising a carrier which releasably contains water and optionally non-water fabric cleaning/refreshment ingredients and instructions for using the fabric bag and one or more absorbent articles to clean and/or refresh a fabric article, the instructions comprising the following steps:

(a) place the fabric article to be cleaned and/or refreshed into the fabric bag;

(b) place one or more absorbent articles into the fabric bag;

(c) place the fabric containment bag containing the fabric article and one or more absorbent articles into an automatic clothes dryer; and (d) operating the automatic clothes dryer such that the fabric article is cleaned and/or refreshed.

It has also now been unexpectedly discovered that certain fabric bags, specifically, those with more than two side walls, form a three dimensional interior void space when they are closed. This three dimensional void space allows the fabric bag to resist collapsing on the fabric articles that are treated within the bag. That is, the fabric bag retains its "billowed" configuration better than conventional envelope style non-fabric plastic bags. Even more surprisingly, the fabric bags of this invention, by virtue of their enhanced three dimensional configuration, tumble more efficiently in a conventional clothes dryer. Specifically, the fabric bags tend to maintain a position in the center of the tumbling drum of a clothes dryer resisting the centrifugal forces that tend to pull common envelope style non-fabric bags to the side walls of the drum where they collapse. By virtue of their design, the fabric bags of this invention tend to maintain their three dimensional shape such that the fabric articles inside the bag are free to tumble, while at the same time being in the controlled environment of a vapor venting fabric bag.

In still yet another aspect of the present invention, a vapor-venting fabric containment bag comprising:

i) an open configuration and a closed configuration;

ii) a VVE rating of at least about 40, preferably at least about 60 and less than about 90, preferably less than about 80, as measured in the Vapor Venting Ev Evaluation Test is provided.

When the bag is in its closed configuration the bag comprises at least three flexible side walls. Further, when the bag is in its closed configuration a three dimensional interior void space is formed whereby the bag resists collapsing. Preferably, the bag comprises at least four side walls configured in the form of a tetrahedron. In another aspect, the bag comprises at least six side walls configured in the form of a cube.

In still yet another aspect of this invention there is provided a process for cleaning or refreshing fabrics by contacting the fabrics with a fabric cleaning/refreshment composition comprising water in a vapor-venting fabric containment bag as described above. In one preferred embodiment, the process is carried out in a hot air clothes dryer at a temperature from about 40° C. to about 240° C., whereby malodors present on the fabrics are vented from the bag by means of the vapor-venting closure.

There is also provided herein a kit for cleaning and/or refreshing fabrics, comprising a package that contains one or more absorbent articles comprising a carrier which releasably contains water and optional non-water fabric cleaning/refreshment ingredients, and a vapor-venting fabric containment bag, and optionally a stain removing system, as described above. In a preferred embodiment, the kit further comprises from one to about ten of the absorbent articles which are disposable after a single use.

All percentages, ratios and proportions herein are by weight, unless otherwise specified. All documents cited are, in relevant part, incorporated herein by reference.

BRIEF DESCRIPTION OF THE DRAWINGS

While this specification concludes with claims that distinctly define the present invention, it is believed that these claims can be better understood by reference to the Detailed Description Of The Invention and the drawings, wherein:

DETAILED DESCRIPTION OF THE INVENTION

Figure 1:
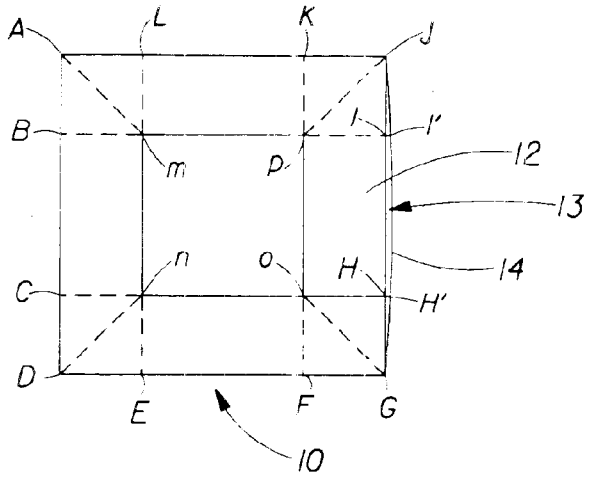
FIG. 1 is a schematic representation of a two sided envelope style fabric bag in accordance with the present invention; the bag is also shown with fold lines for optionally configuring the bag such that a six sided cube is formed as shown in FIG. 2.

It will be appreciated from the disclosures herein that the present invention provides the user with a fabric bag, preferably a woven fabric bag, more preferably a woven polyester fabric bag, most preferably a vapor venting fabric containment bag and/or a three dimensional fabric bag, that can be used for cleaning and refreshing fabrics, especially garments, in a simple, readily available apparatus such as a conventional hot air clothes dryer. The fabric bags and processes of the invention can be used with any type of fabric/garment, including "Dry Clean Only" (DCO) garments. In a preferred embodiment, the user is provided with an article which comprises an absorbent core which releasably contains a cleaning/refreshment composition. In one embodiment, this core with its load of liquid composition is substantially enrobed in an outer cover sheet, which has openings through which the composition is permeable in the vapor state, but which constitutes a barrier through which liquid can flow in, but would be somewhat restrained in the core against flow outward. The liquid-loaded core can also be enrobed in low-density non-water absorbent fabric or non-fabric sheet comprising fibers such as nylon, polyester, polypropylene and the like. In addition, the user can, optionally, also be provided with a separate portion of a spot removal ("pre-spotting") composition.

When treating a fabric (such as a soiled, wrinkled or malodorous garment) in the present manner, the item is first inspected for heavily spotted areas. If none are found, the item being treated is placed in the fabric bag of this invention together with the cleaning/refreshment article herein and tumbled in a hot air clothes dryer in the manner disclosed, i.e., the "in-dryer" step.

If heavily spotted areas are found, it is preferred to treat them individually before the in-dryer step. The pre-spotting steps of this invention are discussed in detail below.

Containment Bag

It has now been discovered that high water content compositions can be loaded onto a carrier substrate such as a cloth or fabric or non-fabric towelette and placed in a bag environment in a heated operating clothes dryer, or the like, to remove malodors from fabrics as a dry cleaning alternative or "fabric refreshment" process. The warm, humid environment created inside this bag volatilizes malodor components in the manner of a "steam distillation" process, and moistens fabrics and the soils thereon. This moistening of fabrics can loosen pre-set wrinkles, but overly wet fabrics can experience setting of new wrinkles during the drying stage toward the end of the dryer cycle. Proper selection of the amount of water used in the process and, importantly and preferably, proper venting of the bag in the present manner can minimize wrinkling. Moreover, venting of the bag permits any volatilized malodorous materials removed from the fabrics to be removed from the bag thus preventing undesirable re-depositing onto the fabrics.

The preferred design of the venting ability of the bag achieves a proper balance of the above effects. A tightly-sealed, vapor impermeable "closed" bag will not purge malodors and will overly moisten the fabrics, resulting in wrinkling. An overly "open" bag design will not sufficiently moisten the fabrics or soils to mobilize heavier malodors or to remove pre-existing fabric wrinkles. Further, the bag must be "closed" enough to billow and create a void volume under water vapor pressure, wherein the fabrics can tumble freely within the bag and be exposed to the vapors. By allowing the fabric articles to tumble freely, wrinkle removal is improved and wrinkle resistance/prevention is enhanced.

Preferably the bag must be designed with sufficient venting to trap a portion of water vapors (especially early in the dryer cycle) but to allow most of the water to escape by the end of the cycle. Said another way, the rate of vapor release is, preferably, optimized to secure a balance of vapor venting and vapor trapping. A preferred bag design employs a water vapor impermeable fabric, preferably a fabric plastic fabric, more preferably a fabric polyethylene terephthalate fabric, with a closure, preferably a zipper, but other closures such as a closure flap like that of a large envelope that employs a hook-and-loop VELCRO®-type fastener can be used.

The fabrics, when removed from the bag, will usually contain a certain amount of moisture. This will vary by fabric type. For example, silk treated in the optimal range shown on the graph may contain from about 0.5% to about 2.5%, by weight, of moisture. Wool may contain from up to about 4%, by weight, of moisture. Rayon also may contain up to about 4% moisture. This is not to say that the fabrics are, necessarily, frankly "damp" to the touch. Rather, the fabrics may feel cool, or cool-damp due to evaporative water losses. The fabrics thus secured may be hung to further air dry, thereby preventing wrinkles from being re-established. The fabrics can be ironed or subjected to other finishing processes, according to the desires of the user.

The present invention thus provides fabric bags, and in a preferred embodiment three dimensional vapor-venting fabric containment bags which are intended for use in fabric cleaning/refreshment operations. The bags are preferably designed for multiple uses and reuses, preferably at least 50 uses, more preferably at least 75 uses and most preferably at least 100 uses, and are especially adapted for use by the consumer in any conventional hot air clothes dryer apparatus, such as those found in the home or in commercial laundry/cleaning establishments. The bags herein are preferably designed to vent water and other vapors which emanate from within the bag when used in the manner described herein. The vapors released from the bag are exhausted through the air vent of the dryer apparatus.

The bag herein is most preferably formed from fabric which is heat resistant up to at least about 204° C.–260° C., preferably up to about 230° C., more preferably up to about 240° C. and most preferably up to about 250° C. Polyethylene terephthalate is a preferred fabric for forming the bag. Other suitable materials known to those of ordinary skill in the art can also be used for the fabric, such as fabric nylon.

As described more fully below, the preferred fabric bags are provided with a vapor-venting closure which provides one or more gaps through which vapors are released from the bag, in-use. For example, if the closure is a zipper, preferably the material, such as fabric attached to the teeth of the zipper allows for sufficient vapor venting of the bag. In a preferred embodiment, the type of closure and material comprising the closure preferably is chosen to permit sufficient vapor venting of the bag in accordance with the present invention. The closure preferably is selected to provide controlled vapor release from the bag under the indicated operating conditions.

Alternatively, the bag can be provided with a series of holes or other fenestrations which provide vapor venting.

However, such venting is not as effective as the vapor-venting closure.

In another embodiment, the edge of one wall of the bag is notched along a substantial portion of its width to facilitate and optimize vapor venting.

In one embodiment, the present invention comprises a fabric bag, preferably a vapor-venting fabric containment bag comprising an open end, a closed end and at least three flexible side walls having inner and outer surfaces, the open end of the bag having a closure, preferably a zipper-like closure.

In yet another embodiment, the present invention encompasses a fabric bag, preferably a vapor-venting fabric containment bag comprising an open end, a closed end and at least three flexible side walls having inner and outer surfaces, the open end of the bag having a section of one side wall extending beyond the open end to provide a flexible flap, the flap having first fastening device affixed thereto, the flap being foldable to extend over a portion of the outside surface of the opposing side wall, the flap being affixable to the outer surface of the opposing wall of the bag by engaging the first fastening device on the inside face of the flap with a second fastening device present on the outside face of the opposing side wall, the first and second fastening devices, when thus engaged, forming a fastener, thereby providing a closure for the open end of the bag. The first and second fastening devices are disposed so as, when engaged, to provide vapor-venting along the closure, especially at the lateral edges of the closure. The first and second fastening devices can form a mechanical fastener or an adhesive fastener.

In an alternate mode, the flap can be folded to provide the closure, tucked inside the opposing side wall, and secured there by a fastener. In this mode, vapors are vented along the closure and especially at the lateral edges of the closure. In yet another mode, the side walls are of the same size and no flap is provided. Fastening devices placed intermittently along portions of the inner surfaces of the side walls are engaged when the lips of the side walls are pressed together to provide closure. One or more vapor-venting gaps are formed in those regions of the closure where no fastening device is present.

While the fastening devices herein can comprise chemical adhesives, the bag is preferably designed for multiple uses. Accordingly, reusable mechanical fasteners are preferred for use herein. Any reusable mechanical fastener or fastening means can be used, as long as the elements of the fastener can be arranged so that, when the bag is closed and the fastener is engaged, a vapor-venting closure is provided. Non-limiting examples include: bags wherein the first and second fastening devices, together, comprise a hook and loop (VELCRO®-type) fastener; hook fasteners such as described in U.S. Pat. No. 5,058,247 to Thomas & Blaney issued Oct. 22, 1991; bags wherein the first and second fastening devices, together, comprise a hook and string type fastener; bags wherein the first and second fastener devices, together, comprise an adhesive fastener; bags wherein the first and second fastening devices, together, comprise a toggle-type fastener; bags wherein the first and second fastening devices, together, form a snap-type fastener; as well as hook and eye fasteners, ZIP LOK®-style fasteners, zipper-type fasteners, and the like, so long as the fasteners are situated so that vapor venting is achieved. Other fasteners can be employed, so long as the vapor-venting is maintained when the bag is closed, and the fastener is sufficiently robust that the flap does not open as the bag and its contents are being tumbled in the clothes dryer. The fastening devices can be situated that the multiple vapor-venting gaps are formed along the closure, or at the lateral edges, or so that the gap is offset to one end of the closure.

Figure 2:
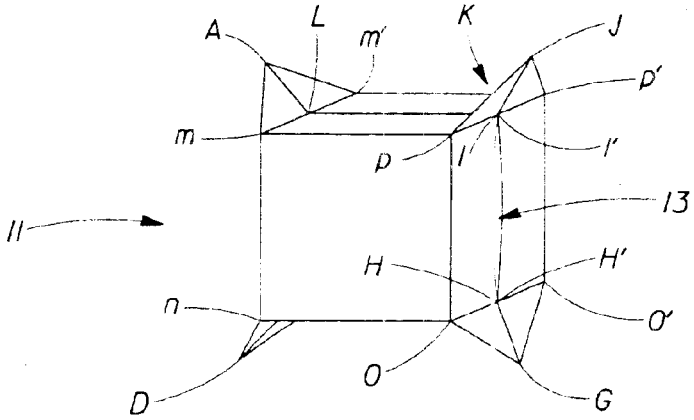
FIG. 2 is a schematic representation of the fabric bag of FIG. 1 after it has been folded along the marked fold lines to form a six sided cube.

Turning now to the drawings wherein FIG. 1 is a schematic representation of a two sided envelope style fabric bag 10. The bag 10 is shown with fold lines inscribed thereon for optionally configuring the bag 10 such that a six sided cube is formed as described below and as shown in FIG. 2. Letters A–P have been used to indicate fold lines and intersection points on side wall 12 of bag 10. The points on the opposite side wall 14 of envelope bag 10, which correspond to the interior points M, N, O and P are labeled M', N', O' and P', respectively. Envelope bag 10 is sealed and/or sewn along edges ALKJ, ABCD and DEFG. Edges JIHG and JI'H'G are a part of side walls 12 and 14, respectively, and these edges define bag opening 13.

When bag 10 is folded along the lines shown (for example, lines LMNE, AM, and CNOH) a six sided cube is formed as shown in FIG. 2 as bag 11. It is highly preferred that the edge lines MM', NN', OO' and PP' be sealed and/or sewn, for example either mechanically or adhesively so that the bag maintains its cube-like configuration. The triangular shaped tips (for example, AMM' and JPP') can be removed or they can be folded against one of the side walls. Alternatively, the triangular shaped tips can be left sticking out to help bag 11 align within the rotary drum of a conventional dryer as shown in FIG. 3.

Figure 3:
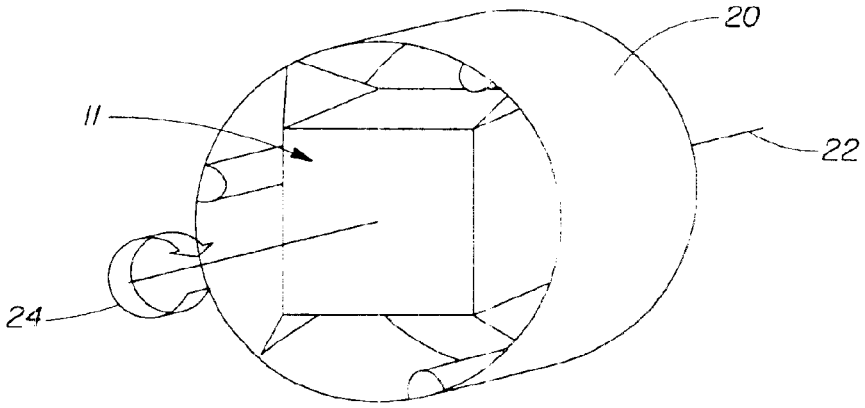
FIG. 3 is a schematic representation of the bag of FIG. 2 inside a rotating drum of a conventional clothes dryer.

Specifically, FIG. 3 shows a six sided bag 11 according to this invention inside of a rotary drum 20 of a conventional clothes dryer (not shown). While not wanting to be bound by any one theory, it is believed that bag 11 and rotary drum 20 both rotate about axis 22 as illustrated by arrow 24. This is in sharp contrast to a conventional envelope style bag which is believed to by drawn to the side walls of the rotary drum by centrifugal forces created as the drum spins about its axis. Once pressed against the side of the drum, an envelope style bag is prone to collapsing. This in turn restricts the interior space of the bag within which the fabric articles have to tumble. As discussed above, a collapsed bag provides sub-optimal cleaning and refreshing for fabric articles.

Figure 4:
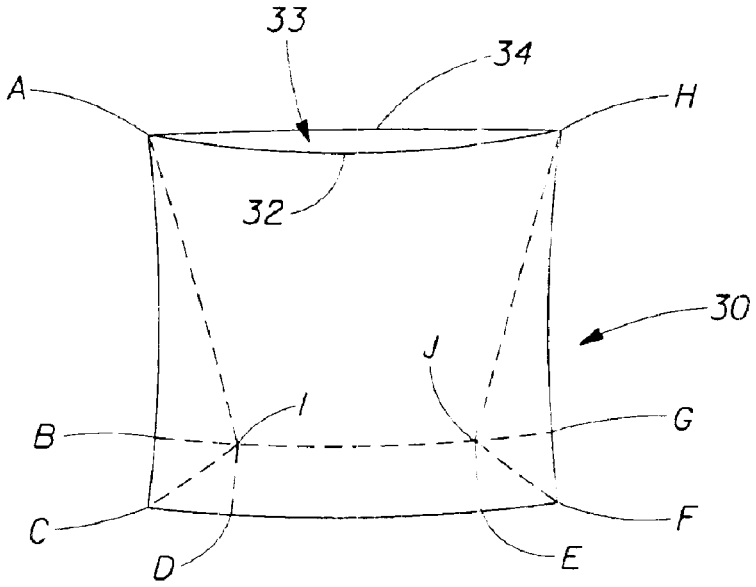
FIG. 4 is a schematic representation of a two sided envelope style fabric bag in accordance with the present invention; the bag is also shown with fold lines for optionally configuring the bag such that a five sided three dimensional bag is formed as shown in FIG. 5.
Figure 5:
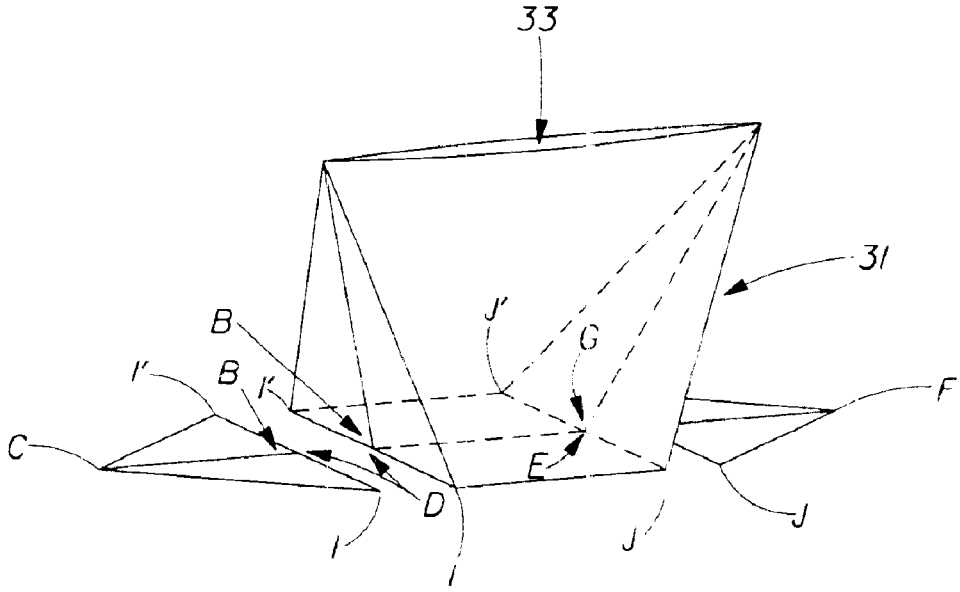
FIG. 5 is a schematic representation of the bag of FIG. 4 after it has been folded along the marked fold lines to form a five sided three dimensional bag.

FIG. 4 is a schematic representation of a two sided envelope style fabric bag 30. The bag 30 is shown with fold lines inscribed thereon for optionally configuring the bag 30 such that a five sided three dimensional bag if formed and described below and as shown in FIG. 5. Letters A–J have been used to indicate fold lines and intersection points on side wall 32 of bag 30. The points on the opposite side wall 34 of envelope bag 30, which correspond to the interior points I and J are labeled I' and J', respectively. Envelope bag 30 is sealed and/or sewn along edges ABC, CDEF and FGH. There are two edges AH, which are part of side walls 32 and 34, respectively, and these edges define bag opening 33.

When bag 30 is folded along the lines shown (for example, lines AID and CI) a five sided bag 31 is formed as shown in FIG. 5. It is highly preferred that the edge lines II' and JJ' be sealed and/or sewn, for example, either mechanically or adhesively, so that the bag maintains its three dimensional configuration. The triangular shaped tips (CII' and FJJ') can be removed as shown or they can be folded against one of the side walls. Alternatively, the triangular shaped tips can be left sticking out to help the bag align within the rotary drum of a conventional dryer.

Figure 6:
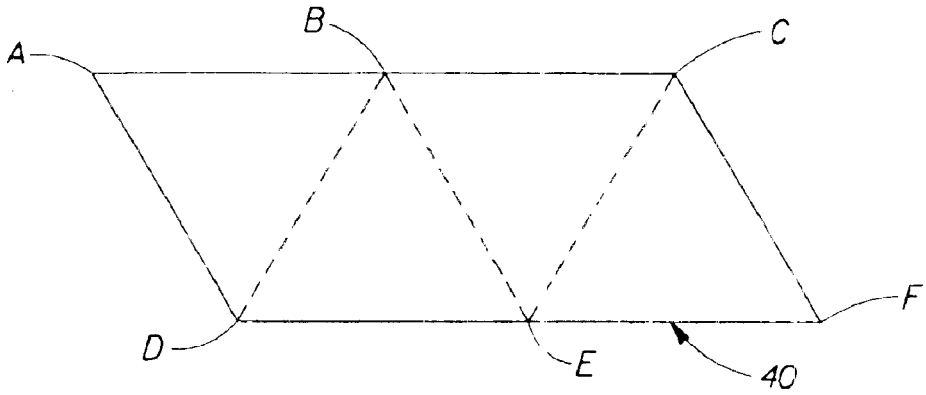
FIG. 6 is a schematic representation of a fabric sheet of bag material in accordance with the present invention; the fabric sheet of bag material is shown with fold lines for optionally configuring the fabric sheet of bag material such that a four sided three dimensional bag is formed as shown in FIG. 7.
Figure 7:
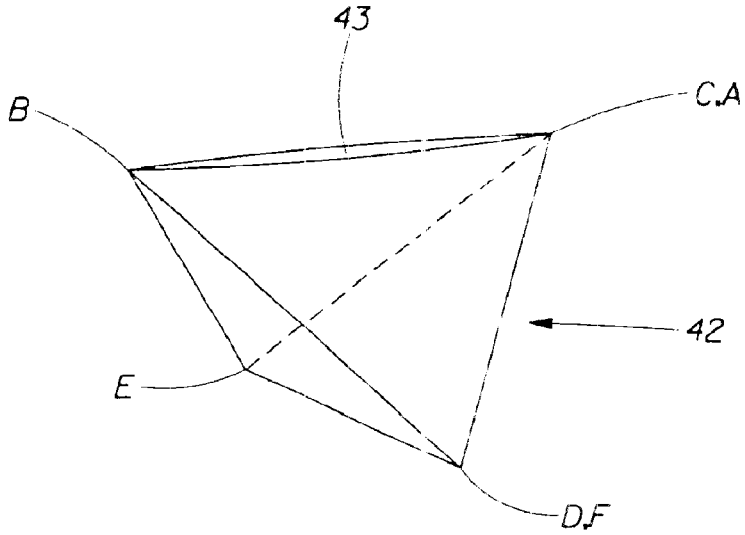
FIG. 7 is a schematic representation of the sheet of FIG. 6 after it has been folded along the marked fold lines to form a four sided three dimensional bag.

FIG. 6 is a schematic representation of a fabric sheet 40 of bag material. The fabric sheet 40 of bag material is shown with fold lines inscribed thereon for optionally configuring the fabric sheet 40 such that a four sided three dimensional bag is formed as described below and as shown in FIG. 7. Letters A–F have been used to indicate fold lines and intersection points on sheet 40. Sheet 40 is folded along lines DB, BE and EC, then edges ED and EF are sealed and/or sewn together, and edges AD and CF are sealed and/or sewn together to form a tetrahedral bag 42, as shown in FIG. 7. Edges BC and BA define bag opening 43, as shown in FIG. 7.

Figure 8:
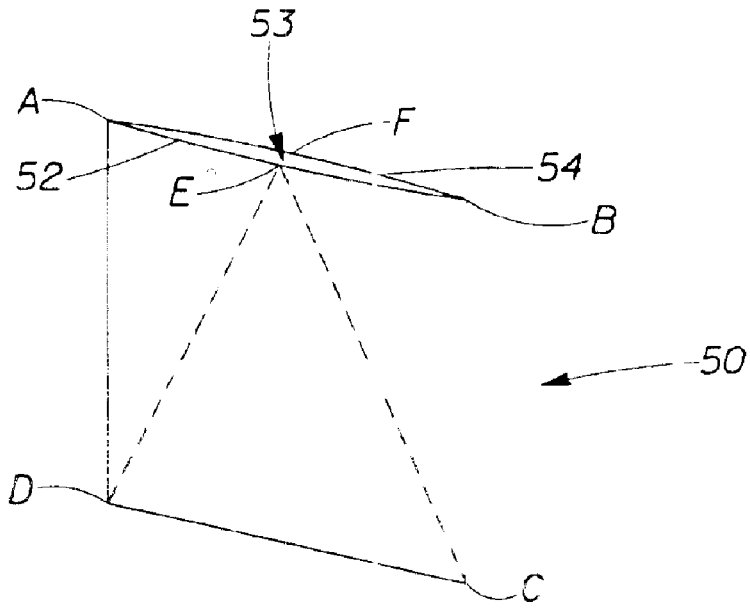
FIG. 8 is a schematic representation of a two sided envelope style fabric bag in accordance with the present invention; the bag is shown with fold lines for optionally configuring the bag such that a four sided three dimensional bag is formed as shown in FIG. 9.
Figure 9:
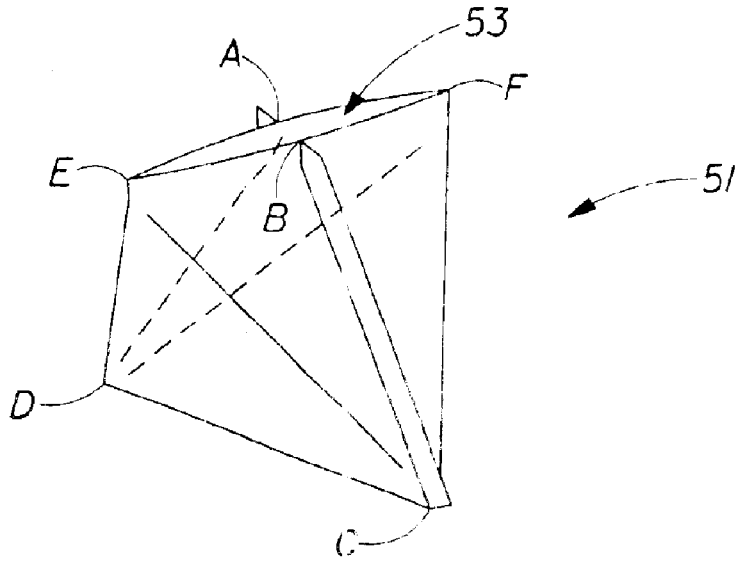
FIG. 9 is a schematic representation of the bag of FIG. 8 after it has been folded along the marked fold lines to form a four sided three dimensional bag.

FIG. 8 is a schematic representation of a two sided envelope style fabric bag 50. The fabric bag 50 is shown with fold lines inscribed thereon for optionally configuring the fabric bag 50 such that a four sided three dimensional bag is formed as described below and as shown in FIG. 9. Letters A–F have been used to indicate fold lines and intersection points on side walls 52 and 54 of bag 50. The fold lines present on side wall 52 are EC and ED. Analogous fold lines are present on side wall 54; namely, F-C and F-D. Bag 50 is sealed and/or sewn along edges AD, DC and BC. There are two edges AEB and AFB, which are part of side walls 52 and 54, respectively, and these edges define bag opening 53. When bag 50 is folded along the lines shown (for example, lines ED and EF) a tetrahedral bag 51 is formed as shown in FIG. 9.

Figure 10:
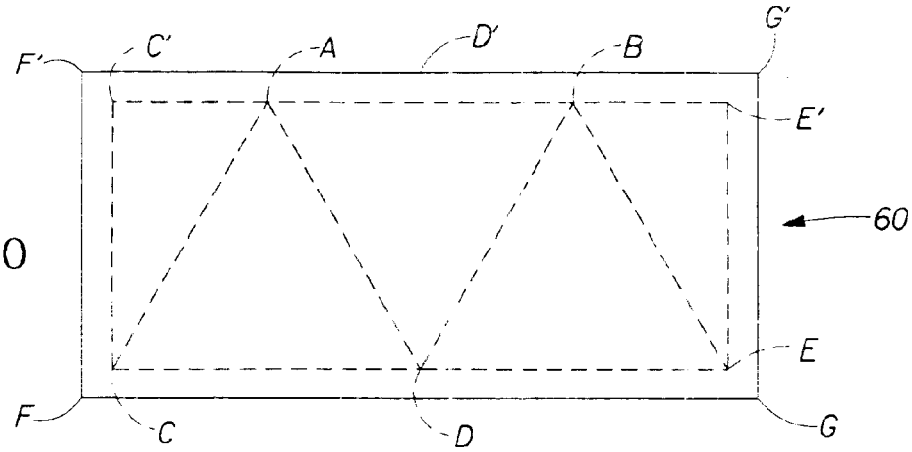
FIG. 10 is a schematic representation of a fabric sheet of bag material in accordance with the present invention; the fabric sheet of bag material is shown with fold lines for optionally configuring the fabric sheet of bag material such that a cylinder is formed as shown in FIG. 11.
Figure 11:
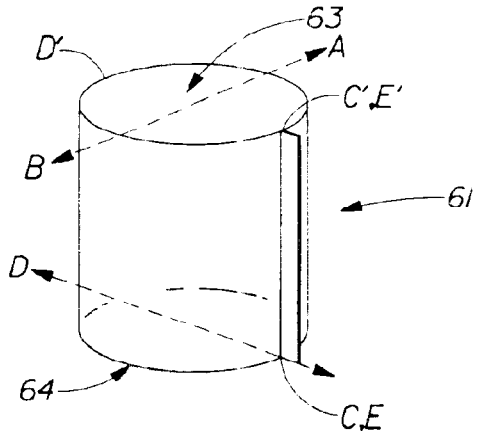
FIG. 11 is a schematic representation of the fabric sheet of FIG. 10 after it has been formed into a cylinder.

FIG. 10 is a schematic representation of a fabric sheet 60 of bag material. The fabric sheet 60 of bag material is shown with fold lines inscribed thereon for optionally configuring the fabric sheet 60 such that a cylinder is formed as described below and as shown in FIG. 11. Letters A–G, C', E', F', and G' have been used to indicate fold lines and intersection points on sheet 60. Letter D' has been used to indicate a mid-point on edge F'G'.

As shown in FIG. 11, the fabric sheet 60 can be formed into a cylinder shape 61 by contacting and preferably sealing and/or sewing fold line EE' to fold line CC' such that a fold line between point CE and C'E' is formed.

Figure 12:
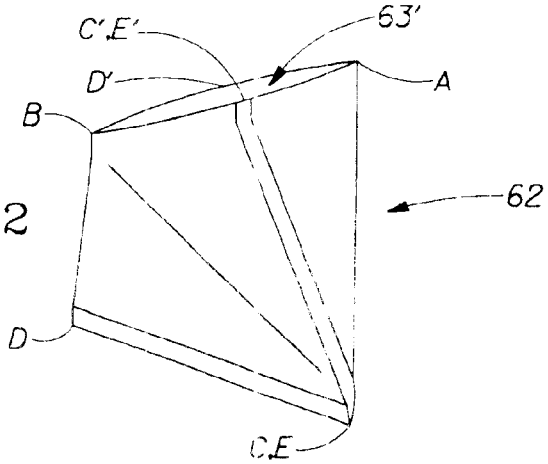
FIG. 12 is a schematic representation of the cylinder of FIG. 11 and ultimately the fabric sheet of FIG. 10 after it has been folded along the marked fold lines to form a four sided three dimensional bag.

An example of one method for forming the tetrahedral fabric bag 62, as shown in FIG. 12, is by forming the cylinder 61, as shown in FIG. 11. The cylinder 61 comprises a first opening 63 and a second opening 64. The second opening 64 is closed by sealing and/or sewing along seal line DC-E. After forming seal DC-E, the cylinder 61 is stretched along stretch line BA such that point D' and C'–E' about come in contact with each other, such that the bag opening 63' of the tetrahedral fabric bag 62 is formed by edges BC'-E'A and BD'A. This method substantially produces the tetrahedral fabric bag 62, as shown in FIG. 12.

Another example of a method for forming the tetrahedral fabric bag 62, as shown in FIG. 12, is by folding the fabric sheet 60 along fold lines CA, AD, DB, BE, then fold lines CC' and EE' are sealed and/or sewn together and fold lines CD and DE are sealed and/or sewn together to form the tetrahedral fabric bag 62. Edges BC'–E'A and BD'A define bag opening 63', as shown in FIG. 12.

Figure 13:
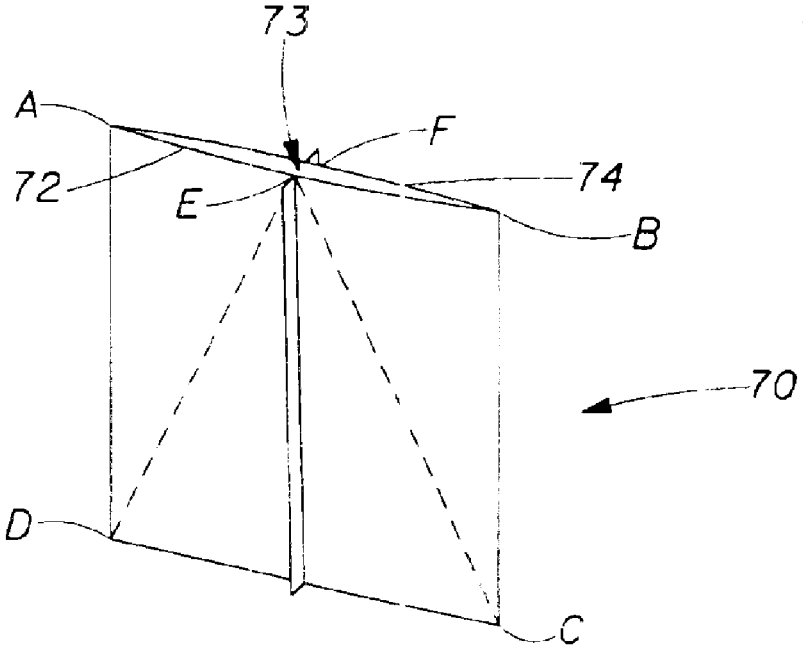
FIG. 13 is a schematic representation of a two sided envelope style fabric bag in accordance with the present invention; the bag is shown with fold lines for optionally configuring the fabric bag such that a four sided three dimensional bag is formed as shown in FIG. 14.
Figure 14:
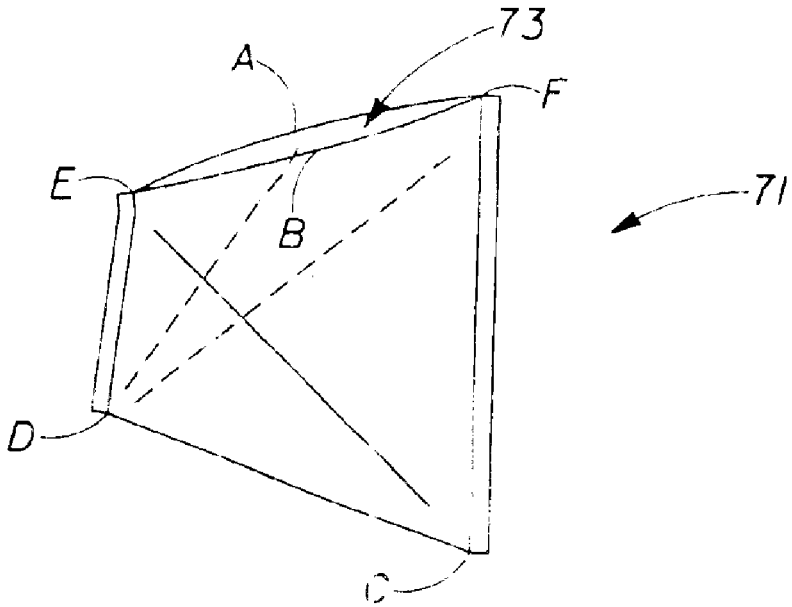
FIG. 14 is a schematic representation of the bag of FIG. 13 after it has been folded along the marked fold lines to form a four sided three dimensional bag.

FIG. 13 is a schematic representation of a two sided envelope style fabric bag 70. The fabric bag 70 is shown with fold lines inscribed thereon for optionally configuring the fabric bag 70 such that a four sided three dimensional bag is formed as described below and as shown in FIG. 14. Letters A–F have been used to indicate fold lines and intersection points on side walls 72 and 74 of bag 70. The fold lines present on side wall 72 are EC and ED. Analogous fold lines are present on side wall 74; namely, FC and FD. Bag 70 is sealed and/or sewn along edges AD, DC and BC. There are two edges AEB and AFB, which are part of side walls 72 and 74, respectively, and these edges define bag opening 73. When bag 70 is folded along the lines shown (for example, lines ED and EC) a tetrahedral fabric bag 71 is formed as shown in FIG. 14. Another method for forming the tetrahedral fabric bag 71 shown in FIG. 14 is closing a closure, such as a zipper, from E to F or F to E. By closing such a closure between EF, the fabric bag 70 automatic configures itself into the tetrahedral fabric bag 71 as shown in FIG. 14.

The construction of the preferred, heat-resistant vapor-venting bags used herein to contain the fabrics in a hot air laundry dryer or similar device preferably employs thermal resistant films to provide the needed temperature resistance to internal self-sealing and external surface deformation sometimes caused by overheated clothes dryers. In addition, the bags are resistant to the chemical agents used in the cleaning or refreshment compositions herein. By proper selection of bag material, unacceptable results such as bag melting, melted holes in bags, and sealing of bag wall-to-wall are avoided. In a preferred mode, the fastener is also constructed of a thermal resistant material. The method of assembling the bags can be varied, depending on the equipment available to the manufacturer and is not critical to the practice of the invention.

The dimensions of the containment bag can vary, depending on the intended end-use. For example, a relatively smaller bag can be provided which is sufficient to contain one or two silk blouses. Alternatively, a larger bag suitable for handling a man's suit can be provided. Typically, the bags herein will have an internal volume of from about 10,000 $cm^3$ to about 25,000 $cm^3$. Bags in this size range are sufficient to accommodate a reasonable load of fabrics (e.g., 0.2–5 kg) without being so large as to block dryer vents in most U.S.-style home dryers. Somewhat smaller bags may be used in relatively smaller European and Japanese dryers.

The bags herein are preferably flexible, yet are preferably durable enough to withstand multiple uses. The bags also preferably have sufficient stiffness that they can billow, in-use, thereby allowing its contents to tumble freely within the bag during use.

The inner surface or parts thereof of the fabric bag of the present invention preferably comprises a moisture barrier that inhibits the drying of the fabrics such that the fabrics do not become too dry before the operation is complete. Preferred moisture barriers include inner coating layers, preferably made of plastic, more preferably selected from the group consisting of polybutylene terephthalate, polypropylene, nylon and mixtures thereof. The moisture barrier is preferably made from a material that resists melting up to at least about 155° C., more preferably up to about 180° C., even more preferably up to about 195° C., most preferably up to about 209° C. This inner coating layer is preferably extruded onto the inner surface or parts thereof of the fabric bag. Nonlimiting examples of coating processes include extrusion coating of the fabric components of the fabric bag; knife-coating of the fabric components of the fabric bag; adhesive-laminating of the coating to the fabric components of the fabric bag. Without being bound by theory, it is believed that this inner coating layer functions as a moisture barrier to prevent the fabrics contained within the fabric bag from over-drying during use.

Process for Making Bag

The fabric bags and/or fabrics making up the fabric bags of the present invention can be made by any suitable process, especially textile processes such as conducted in textile mills, known to those of ordinary skill in the art. Preferably, the fabrics are woven from polyester fibers, preferably 150 denier plain weave fibers. Nonlimiting examples of such fibers are commercially available from DUPONT under the trade name DACRON®.

Vapor Venting Evaluation

A preferred containment bag in accordance with the present invention is a vapor-venting containment bag. In its broadest sense, the preferred vapor-venting containment bag used in this invention is designed to be able to vent at least about 40%, preferably at least about 60%, up to about 90%, preferably no more than about 80%, by weight, of the total moisture introduced into the bag within the operating cycle of the clothes dryer or other hot air apparatus as measured according to the Vapor-Venting Evaluation Test described herein. (Of course most, if not all, of organic cleaning solvents, if any, will also be vented during use together with the water. However, since water comprises by far the major portion of the cleaning/refreshment compositions herein, it is more convenient to measure and report the venting as water vapor venting.)

It will be appreciated by those knowledgeable about the operation of hot air clothes dryers and similar apparatus that the rate of venting will usually not be constant over the entire operating cycle. All dryers have a warm-up period at the beginning of the operating cycle, and this can vary according to the specifications of the manufacturer. Most dryers have a cool-down period at the end of the operating cycle. Some venting from the containment bag can occur during these warm-up and cool-down periods, but its rate is generally less than the venting rate over the main period of the drying cycle. Moreover, even during the main period of the cycle, many modern dryers are constructed with thermostat settings which cause the air temperature in the dryer to be increased and decreased periodically, thereby preventing overheating. Thus, an average, rather than constant, dryer operating temperature in the target range of from about 50° C. to about 85° C. is typically achieved.

Moreover, the user of the present containment bag may choose to stop the operation of the drying apparatus before the cycle has been completed. Some users may wish to secure fabrics which are still slightly damp so that they can be readily ironed, hung up to dry, or subjected to other finishing operations.

Apart from the time period employed, the Vapor-Venting Equilibrium ("VVE") for any given type of vapor-venting closure will depend mainly on the temperature achieved within the dryer—which, as noted above, is typically reported as an average "dryer air temperature". In point of fact, the temperature reached within the containment bag is more significant in this respect, but can be difficult to measure with accuracy. Since the heat transmittal through the walls of the bag is rather efficient due to the thinness of the walls and the tumbling action afforded by conventional clothes dryers, it is a reasonable approximation to measure the VVE with reference to the average dryer air temperature.

Moreover, it will be appreciated that the vapor-venting from the containment bag should not be so rapid that the aqueous cleaning/refreshment composition does not have the opportunity to moisten the fabrics being treated and to mobilize and remove the soils/malodors therefrom. However, this is not of practical concern herein, inasmuch as the delivery of the composition from its carrier substrate onto the fabrics afforded by the tumbling action of the apparatus occurs at such a rate that premature loss of the composition by premature vaporization and venting is not a significant factor. Indeed, the preferred bag herein is designed to prevent such premature venting, thereby allowing the liquid and vapors of the cleaning/refreshment composition to remain within the bag for a period which is sufficiently long to perform its intended functions on the fabrics being treated.

One embodiment of a vapor-venting containment bag comprises an open end, a closed end and flexible side walls having inner and outer surfaces, the open end of said bag having a section of one side wall extending beyond said open end to provide a flexible flap, said flap having first fastening device, said flap being foldable to extend over a portion of the outside surface of the opposing side wall, said flap being affixable to the outer surface of the opposing side wall of the bag by engaging said first fastening device with a second fastening device present on said opposing side wall, thereby providing a closure for the open end of the bag, said first and second fastening devices being disposed so as, when engaged, to provide at least one vapor-venting gap along said closure.

Another such vapor-venting containment bag comprises an open end, a closed end and flexible side walls having inner and outer surfaces, the side walls being of equal length, wherein the first side wall is notched over part of its width, whereby said opposing side wall thereby extends beyond said notched portion of said first side wall, thereby providing a flexible flap, said flap being foldable over said notched portion to provide a vapor-venting gap when said bag is closed.

In another mode, there is provided a vapor-venting bag with the aforesaid VVE ratings whose side walls are fenestrated. A combination of vapor-venting closure and fenestrations can also be used to achieve the desired VVE.

In yet another embodiment, such a vapor-venting containment bag comprises open end, a closed end and flexible side walls having inner and outer surfaces, the side walls being of equal length, and a closure that substantially closes the open end, but does not completely close the open end such that sufficient vapor-venting from the bag is achieved.

In still another embodiment, such a vapor-venting containment bag comprises open end, a closed end and flexible side walls having inner and outer surfaces, the side walls being of equal length, and a closure that completely closes the open end of the bag, but the closure permits sufficient vapor-venting in accordance with the present invention.

The vapor-venting containment bag facilitates venting of malodors from the bag via the vapor-venting feature and/or providing any fabrics within the vapor-venting containment bag, wrinkle removal and/or wrinkle resistance benefits.

Thus, different from art-disclosed processes, the vapor-venting containment bag of the present invention provides, in a process for cleaning/refreshing fabrics in a mechanical apparatus by placing said fabrics in a fabric vapor-venting containment bag together with a cleaning/refreshment composition and operating said apparatus with heating, such that during venting of water vapors from said bag during said process malodors are released from the bag and fabric wrinkling is minimized. These benefits are optimally secured when the VVE rating of said bag is at least about 40. The process can be conducted in any apparatus, but is conveniently conducted with heating and tumbling in a hot air clothes dryer.

The following Vapor-Venting Evaluation Test (VVET) illustrates the foregoing points in more detail. Larger or smaller containment bags can be used, depending on the volume of the dryer drum, the size of the fabric load, and the like. As noted above, however, in each instance the containment bag is designed to achieve a degree of venting, or VVE "score", of at least about 40% (40 VVE), preferably at least about 60% (60 VVE), up to about 90% (90 VVE).

Vapor-Venting Evaluation Test

Materials:

Fabric Bag to be evaluated for VVE.

Carrier Substrate (15"×11"; 38.1 cm×27.9 cm) HYDRASPUN® carrier substrate sheet from Dexter with (10444) or without (10244) Binder Wool Blouse: RN77390, Style 12288, Weight approx. 224 grams Silk Blouse: RN40787, Style 0161, Weight approx. 81 grams Rayon Swatch: 45"×17" (114.3 cm×43.2 cm), Weight approx. 60 grams Pouch: 5"×6.375" (12.7 cm×16.2 cm) to contain the Carrier Substrate and water De-ionized Water; Weight is variable to establish VVE.

Pretreatment of Fabrics:

1. The wool, silk, and rayon materials are placed in a Whirlpool dryer (Model LEC7646DQO) for 10 minutes at high heat setting, with the heating cycle ranging from about 140° F.–165° F. to remove moisture picked up at ambient condition.
2. The fabrics are then removed from the dryer and placed in sealed nylon or plastic bags (minimum 3 mil. thickness) to minimize moisture pick up from the atmosphere.

Test Procedure:

1. Water of various measured weights from 0 to about 40 grams is applied to the carrier substrate a minimum of 30 minutes before running a vented bag test. The substrate is folded, placed in a pouch and sealed.
2. Each fabric is weighed separately and the dry weights are recorded. Weights are also recorded for the dry carrier substrate, the dry pouch containing the substrate, and the dry containment bag being evaluated.
3. Each garment is placed in the bag being evaluated for vapor venting along with the water-containing substrate (removed from its pouch and unfolded).
4. The bag is closed without expressing the air and placed in the Whirlpool Dryer for 30 minutes at the high heat setting, with tumbling per the standard mode of operation of the dryer.
5. At the end of 30 minutes the bag is removed from the dryer and each fabric, the carrier substrate, the bag and the pouch are weighed for water weight gain relative to the dry state. (A possible minor loss in weight for the containment bag due to dryer heat is ignored in the calculations.)
6. The weight gain of each garment is recorded as a percent of the total moisture applied to the carrier substrate.
7. The remaining unmeasured moisture divided by the total moisture is recorded as percent vented from the dryer bag.
8. When a series of total applied moisture levels are evaluated, it is seen that above about 15–20 grams of water the % vented becomes essentially constant, and this is the Vapor-Venting Equilibrium value, or VVE, for the particular bag venting design.

It can be seen from examining a series of VVET results at various initial moisture levels that the water at lower initial levels is being disproportionately captured by the garment load, the headspace, and the nylon bag, such that venting of water and volatile malodors begins in earnest only after the VVE value is achieved. Since this occurs only when about 15–20 grams or more of water is initially charged, it is seen that a VVE of greater than about 40 is needed to avoid excessive wetting of garments, leading to unacceptable wet-setting of wrinkles, as discussed herein.

Malodor and/or Wrinkle Removal

The overall process herein optionally comprises a spot removal step on isolated, heavily stained areas of the fabric. Following this localized stain removal step, the entire fabric can be cleaned/refreshed in the fabric containment bag, preferably the vapor-venting containment bag. This latter step provides a marked improvement in the overall appearance and refreshment of fabrics, especially with respect to the near absence of malodors and wrinkles, as compared with untreated fabrics.

One assessment of this step of the process using the vapor-venting fabric containment bag herein with respect to malodors comprises exposing the fabrics to be tested to an atmosphere which contains substantial amounts of cigarette smoke. In an alternate mode, or in conjunction with the smoke, the fabrics can be exposed to the chemical components of synthetic perspiration, such as the composition available from IFF, Inc. Expert olfactory panelists are then used to judge odor on any convenient scale. For example, a scale of 0 (no detectable odor) to 10 (heavy malodor) can be established and used for grading purposes. The establishment of such tests is a matter of routine, and various other protocols can be devised according to the desires of the formulator.

For example, garments to be "smoked" are hung on clothing hangers in a fume hood where air flow has been turned off and vents blocked. Six cigarettes with filters removed are lighted and set in ashtrays below the garments. The hood is closed and left until the cigarettes have about half burned. The garments are then turned 180.degree. to get even distribution of smoke on all surfaces.

Smoking is then continued until all cigarettes are consumed. The garments are then enclosed in sealed plastic bags and allowed to sit overnight.

After aging for about one day, the garments are treated in the cleaning/refreshment process using the venting bag. The garments are removed promptly from the containment bag when the dryer cycle is finished, and are graded for malodor intensity. The grading is done by an expert panel, usually two, of trained odor and perfume graders. The malodor intensity is given a grade of 0 to 10, where 10 is full initial intensity and 0 is no malodor detected. A grade of 1 is a trace detection of malodor, and this grade is regarded as acceptably low malodor to most users.

In the absence of perfume ingredients in the cleaning cloth composition, the grading of residual malodor intensity is a direct indication of degree of cleaning or removal of malodorous chemicals. When perfumed compositions are used, the grading panelists can also determine a score for perfume intensity and character (again on a 0 to 10 scale), and the malodor intensity grading in this case would indicate the ability of the residual perfume to cover any remaining malodorous chemicals, as well as their reduction or removal.

After the garment odor grading taken promptly after the cleaning/refreshment process, the garments are hung in an open room for one hour and graded again. This one-hour reading allows for an end-effect evaluation that would follow cool-down by the garments and drying of the moisture gained in the dryer cycle treatment. The initial out-of-bag grading does reflect damp-cloth odors and a higher intensity of warm volatiles from the bag, and these are not factors in the one-hour grades. Further garment grading can be done at 24 hours and, optionally, at selected later times, as test needs dictate.

Likewise, fabric wrinkles can be visually assessed by skilled graders. For example, silk fabric, which wrinkles rather easily, can be used to visually assess the degree of wrinkle-removal achieved by the present processes using the vapor-venting bag. Other single or multiple fabrics can optionally be used. A laboratory test is as follows.

De-Wrinkling Test

Materials:

As above for VVET.

De-ionized Water, Weight range (0–38 grams)

Pretreatment of Fabrics:

The silk fabric is placed in a hamper, basket, or drum to simulate normal conditions that are observed after wearing. These storage conditions produce garments that are severely wrinkled (well defined creases) and require a moist environment to relax the wrinkles.

Test Procedure:

1. One silk fabric is placed in a containment bag being tested.
2. Water (0–38 grams) is applied to the carrier substrate a minimum of 30 minutes before running the test, placed in a pouch and sealed.
3. The silk garment is placed in the test containment bag along with the water-containing substrate (removed from its pouch and unfolded).
4. The bag is closed and placed in a Whirlpool Dryer (Model LEC7646DQO) for 30 minutes at high heat (48–74 C cycle).
5. At the end of 30 minutes, the dryer bag is removed from the dryer IMMEDIATELY and the silk garment is placed on a hanger.
6. The silk garment is then visually graded versus the Control Garment from the same Pretreatment Of Fabrics.

In laboratory tests of the foregoing type, the in-dryer, non-immersion cleaning/refreshment processes herein typically provide malodor (cigarette smoke and/or perspiration) malodor grades in the 0–1 range for smoke and somewhat higher for perspiration malodors, thereby indicating good removal of malodor components other than those of sufficiently high molecular weights that they do not readily "steam vaporize" from the fabrics. Likewise, fabrics (silks) have wrinkles removed to a sufficient extent that they are judged to be reasonably suitable for wearing with little, or no, ironing.

Perfume—As noted above, various treatment agents can be applied to the fabrics during the present process. One type of agent comprises various perfume materials. However, the perfumer should select at least some perfume chemicals which are sufficiently high boiling that they are not entirely vented from the bag along with the water vapors during the drying process herein.

A wide variety of aldehydes, ketones, esters, acetals, and the like, perfumery chemicals which have boiling points above about 50.degree. C., preferably above about 85.degree. C., are known. Such ingredients can be delivered by the process herein and caused to permeate the garments of the containment bag during the processes herein. Non-limiting examples of perfume materials with relatively high boiling components include various essential oils, resinoids, and resins from a variety of sources including but not limited to orange oil, lemon oil, patchouli, Peru balsam, Olibanum resinoid, styrax, labdanum resin, nutmeg, cassia oil, benzoin resin, coriander, lavandin and lavender. Still other perfume chemicals include phenyl ethyl alcohol, terpineol and mixed pine oil terpenes, linalool, linalyl acetate, geraniol, nerol, 2-(1,1-dimethylethyl)-cyclohexanol acetate, orange terpenes and eugenol. Of course, lower boiling materials can be included, with the understanding that some loss will occur due to venting.

Cleaning And Refreshing Processes

As discussed briefly above, the cleaning and refreshing processes of this invention include the following steps. The cleaning/refreshment composition is loaded on the substrate which is preferably encased in a coversheet, and the substrate is placed in a bag according to this invention with the fabrics to be treated. The bag is closed and placed in a heated operating clothes dryer, or the like, to remove malodors from the fabrics.

In more detail, the cleaning and refreshing process herein can be conducted in the following manner. Modifications of the process can be practiced without departing from the spirit and scope of the present invention.

(i) optionally, conducting a pre-spotting process according to the description below, on localized stained areas of the fabric;

(ii) placing the entire fabric together with the substrate that releasably contains a cleaning/refreshment composition in a fabric containment bag in accordance with the present invention;

(iii) placing the bag in a device to provide agitation, e.g., such as in a hot air clothes dryer and operating the dryer with heat and tumbling to moisten the fabric; and (iv) removing the fabric from the bag.

(v) promptly hanging the fabrics to complete drying and/or to prevent re-wrinkling.

More specifically, the cleaning and refreshment process is conveniently conducted in a tumbling apparatus, preferably in the presence of heat. The substrate containing the releasably absorbed shrinkage reducing composition and cleaning/refreshment composition is placed along with the fabrics to be treated in a nylon or other heat-resistant, and preferably vapor-venting bag. The bag is closed and placed in the drum of an automatic hot air clothes dryer at temperatures of 40° C.–150° C. The drum is allowed to revolve, which imparts a tumbling action to the bag and agitation of its contents concurrently with the tumbling. The tumbling and heating are carried out for a period of at least about 10 minutes, typically from about 20 minutes to about 60 minutes. This step can be conducted for longer or shorter periods, depending on such factors as the degree and type of soiling of the fabrics, the nature of the soils, the nature of the fabrics, the fabric load, the amount of heat applied, and the like, according to the needs of the user.

In more detail, a pre-spotting process can be conducted in the following manner. Modifications of the process can be practiced without departing from the spirit and scope of the present invention.

1. Place a stained area of the fabric over and in contact with the absorbent stain receiving article, preferably a poly-HIPE or TBAL stain receiver described herein or, less preferably, an ordinary folded paper towel (e.g., preferably white or non-printed—to avoid dye transfer from the towel—BOUNTY® brand) on any suitable surface such as a table top, in a tray, etc.
2. Apply enough spot cleaning composition from a dispenser bottle with a narrow spout which directs the composition onto the stain (without unnecessarily saturating the surrounding area of the fabric) to saturate the localized stained area—about 10 drops; more may be used for a larger stain.
3. Optionally, let the composition penetrate the stain for 3–5 minutes.
4. Optionally, apply additional composition—about 10 drops; more may be used for larger stains.
5. Use the treatment member, such as the distal tip on the dispenser bottle to work the stain completely out.

Contact can be maintained for a period of 1–60 seconds for lighter stains and 1–5 minutes, or longer, for heavier or more persistent stains.

6. Optionally, blot the fabric, e.g., between paper towels, to remove excess composition. Or, the treated area can be blotted with a dampened sponge or other absorbent medium to flush the fibers and remove excess composition.

Cleaning/Refreshment Composition

The cleaning/refreshment composition preferably comprises water and a member selected from the group consisting of surfactants, perfumes, preservatives, bleaches, auxiliary cleaning agents, organic solvents and mixtures thereof. The preferred organic solvents are glycol ethers, specifically, methoxy propoxy propanol, ethoxy propoxy propanol, propoxy propoxy propanol, butoxy propoxy propanol, butoxy propanol and mixtures thereof. The surfactant is preferably a nonionic surfactant, such as an ethoxylated alcohol or ethoxylated alkyl phenol, and is present at up to about 2%, by weight of the cleaning/refreshment composition. Typical fabric cleaning refreshment/compositions herein can comprise at least about 80%, by weight, water, preferably at least about 90%, and more preferably at least about 95% water.

The Examples below give specific ranges for the individual components of preferred cleaning/refreshment compositions for use herein. A more detailed description of the individual components of the cleaning/refreshment compositions, that is, the organic solvents, surfactants, perfumes, preservatives, bleaches and auxiliary cleaning agents can be found in U.S. Pat. No. 5,789,368, which issued on Aug. 4, 1998 to You et al. and in U.S. Pat. No. 5,591,236, which issued on Jan. 7, 1997 to Roetker. The entire disclosure of the You et al. and the Roetker patents are incorporated herein by reference. Additionally, cleaning/refreshment compositions are described in co-pending U.S. patent application Ser. No. 08/789,171, which was filed on Jan. 24, 1997, in the name of Trinh et al. The entire disclosure of the Trinh et al. Application is incorporated herein by reference.

It is especially preferred that the cleaning/refreshment compositions of this invention include a shrinkage reducing composition, which is preferably selected from the group consisting of ethylene glycol, all isomers of propanediol, butanediol, pentanediol, hexanediol and mixtures thereof, and more preferably selected from the group consisting of neopentyl glycol, polyethylene glycol, 1,2-propanediol, 1,3-butanediol, 1-octanol and mixtures thereof. The shrinkage reducing composition is preferably neopentyl glycol or 1,2-propanediol, and is more preferably 1,2-propanediol. The ratio of shrinkage reducing composition to cleaning/refreshment composition is preferably from about 1:2 to about 1:5, preferably from about 1:2 to about 1:4, more preferably from about 1:3 to about 1:4, and most preferably about 1:3.6.

In addition to the above ingredients, the cleaning/refreshment composition may optionally comprise a bleaching agent, preferably hydrogen peroxide.

Substrate

When used in the in-dryer step of the present process, the cleaning/refreshment composition is releasably absorbed an absorbent substrate, herein after referred to as a "substrate". The substrate releasably contains the composition. By "releasably contains" means that the composition is effectively released from the substrate onto the soiled fabrics as part of the non-immersion cleaning and fabric refreshment processes herein. This release occurs mainly by volatilization of the composition from the substrate through the vapor-permeable coversheet, or by a combination of vapor and liquid transfer, although bulk liquid transfer is desirably minimized by means of the coversheet herein.

The substrate can be in any desired form, such as powders, flakes, shreds, and the like. However, it is highly preferred that the substrate be in the form of an integral pad or "sheet" that substantially maintains its structural integrity throughout the process. The substrates and sheets of this invention are sometimes referred to in the literature as "carriers" or "absorbent carrier sheets"; it is understood that all of these labels refer to liquid absorbing materials that can be used to conveniently transport liquids. Such substrates are described in detail in U.S. Pat. No. 5,789,368, to You et al. which was incorporated herein by reference above. The manufacture of these sheets forms no part of this invention and is already disclosed in the literature. See, for example, U.S. Pat. No. 5,009,747, Viazmensky, et al., Apr. 23, 1991 and U.S. Pat. No. 5,292,581, Viazmensky, et al., Mar. 8, 1994, which are incorporated herein by reference.

A preferred substrate herein comprises a binderless (or optional low binder), hydroentangled absorbent material, especially a material which is formulated from a blend of cellulosic, rayon, polyester and optional bicomponent fibers. Such materials are available from Dexter, Non-Wovens Division, The Dexter Corporation as HYDRASPUN®, especially Grade 10244 and 10444. The manufacture of such materials forms no part of this invention and is already disclosed in the literature. See, for example, U.S. Pat. No. 5,009,747, Viazmensky, et al., Apr. 23, 1991 and U.S. Pat. No. 5,292,581, Viazmensky, et al., Mar. 8, 1994, incorporated herein by reference. Preferred materials for use herein have the following physical properties.

| | Grade 10244 | Targets | Optional Range |
|---|---|---|---|
| Basis Weight | $gm/m^2$ | 55 | 35–75 |
| Thickness | microns | 355 | 100–1500 |
| Density | gm/cc | 0.155 | 0.1–0.25 |
| Dry Tensile | gm/25 mm | | |
| MD | | 1700 | 400–2500 |
| CD | | 650 | 100–500 |
| Wet Tensile | gm/25 mm | | |
| MD* | | 700 | 200–1250 |
| CD* | | 300 | 100–500 |
| Brightness | % | 80 | 60–90 |
| Absorption Capacity | % | 735 | 400–900 $H_2O$ |
| Dry Mullen | $gm/cm^2$ | 1050 | 700–1200 |

*MD—machine direction; CD—cross direction

As disclosed in U.S. Pat. Nos. 5,009,747 and 5,292,281, the hydroentangling process provides a nonwoven material which comprises cellulosic fibers, and preferably at least about 5% by weight of synthetic fibers, and requires less than 2% wet strength agent to achieve improved wet strength and wet toughness.

The substrate is intended to contain a sufficient amount of the cleaning/refreshment composition to be effective for the intended purpose. The capacity of the substrate for such compositions will vary according to the intended usage. The size of the substrate should not be so large as to be unhandy for the user. Typically, the dimensions of the substrate will be sufficient to provide a macroscopic surface area (both sides of the substrate) of at least about 360 $cm^2$, preferably in the range from about 360 $cm^2$ to about 3000 $cm^2$. For example, a generally rectangular substrate may have the dimensions (X-direction) of from about 10 cm to about 35 cm, and (Y-direction) of from about 18 cm to about 45 cm.

Coversheet

The coversheets employed herein are distinguished from the substrate, inasmuch as the coversheets are relatively non-absorbent to the cleaning/refreshment composition as compared with the substrate. The coversheets are constructed from hydrophobic fibers which tend not to absorb, "wick" or otherwise promote the transfer of fluids. While fluids can pass through the void spaces between the fibers of the coversheet, this occurs mainly when excessive pressure is applied to the article. Thus, under typical usage conditions the coversheet provides a physical barrier which keeps the absorbent substrate, which is damp from its load of shrinkage reducing composition and cleaning/refreshment composition, from coming into direct contact with the fabrics being treated. Yet, the coversheet does allow vapor transfer of the shrinkage reducing composition and cleaning/refreshment composition from the substrate through the coversheet and into the containment bag, and thus onto the fabrics being treated. If desired, the coversheet can be provided with macroscopic fenestrations through which the lint, fibers or particulate soils can pass, thereby further helping to entrap such foreign matter inside the article, itself.

Such fibrous, preferably heat resistant and, most preferably, hydrophobic, coversheets are described in detail in U.S. Pat. No. 5,789,368, to You et al. which was incorporated herein by reference above. Additionally, co-pending U.S. provisional application 60/077,556, which was filed on Mar. 11, 1998, in the name of Wise et al., describes certain improvements to the coversheets of this invention. The entire disclosure of the Wise et al. application is incorporated herein by reference. Suitable combinations of the coversheets described in You et al. with the improvements described in Wise et al. can be employed, according to the desires of the manufacturer, without departing from the spirit and scope of the invention.

Spot Cleaning Composition

The user of the present process can be provided with various spot cleaning compositions to use in the optional pre-spotting procedure of this invention. These compositions are used to remove localized stains from the fabrics being treated, either before or after the cleaning and refreshing process defined herein. Necessarily, the spot cleaning composition must be compatible with the fabric being treated. That is, no meaningful amount of dye should be removed from the fabric during the spot treatment and the spot cleaning composition should leave no visible stains on the fabric. Therefore, in a preferred aspect of this invention there are provided spot cleaning compositions which are substantially free of materials that leave visible residues on the treated fabrics. This necessarily means that the preferred compositions are formulated to contain the highest level of volatile materials possible, preferably water, typically about 95%, preferably about 97.7%, and surfactant at levels of about 0.1% to about 0.7%. A preferred spot cleaning composition will also contain a cleaning solvent such as butoxy propoxy propanol (BPP) at a low, but effective, level, typically about 1% to about 4%, preferably about 2%.

Preferred spot cleaning compositions are exemplified below, and are described in U.S. Pat. No. 5,789,368, to You et al. which was incorporated herein by reference above. Additionally, spot cleaning compositions are described in U.S. Pat. No. 5,630,847, which issued on May 20, 1997, to Roetker. The entire disclosure of the Roetker patent is incorporated herein by reference.

Treatment Member

In one embodiment, a treatment member is provided to assist in removing localized stains from fabrics. In a preferred aspect of this invention, the spot cleaning composition is provided in a dispenser, such as a bottle, and the dispenser has a distal tip that can serve as the treatment member. Additionally, the treatment member can comprise an absorbent base material which can be, for example, a natural or synthetic sponge, an absorbent cellulosic sheet or pad, or the like. In contact with and extending outward from this base material can be multiple protrusions. Specific examples of treatment members can be found in U.S. Pat. No. 5,789,368, to You et al. which was incorporated herein by reference above.

Absorbent Stain Receiving Article

An absorbent stain receiving article, sometimes referred to herein as a stain receiver, can optionally be used in the optional pre-spotting operations herein. Such stain receivers can be any absorbent material which imbibes the liquid composition used in the pre-spotting operation. Disposable paper towels, cloth towels such as BOUNTY™ brand towels, clean rags, etc., can be used. However, in a preferred mode the stain receiver is designed specifically to "wick" or "draw" the liquid compositions away from the stained area. One preferred type of stain receiver consists of a nonfabric pad, such as a thermally bonded air laid fabric ("TBAL"). Another highly preferred type of stain receiver for use herein comprises polymeric foam, wherein the polymeric foam comprises a polymerized water-in-oil emulsion, sometimes referred to as "poly-HIPE". The manufacture of polymeric foam is very extensively described in the patent literature; see, for example: U.S. Pat. No. 5,260,345 to DesMarais, Stone, Thompson, Young, LaVon and Dyer, issued Nov. 9, 1993; U.S. Pat. No. 5,550,167 to DesMarais, issued Aug. 27, 1996, and U.S. Pat. No. 5,650,222 to DesMarais et al., issued Jul. 22, 1997, all incorporated herein by reference. Typical conditions for forming the polymeric foams of the present invention are described in co-pending U.S. patent application Ser. No. 09/042,418, filed Mar. 13, 1998 by T. A. DesMarais, et al., titled "Absorbent Materials for Distributing Aqueous Liquids", the disclosure of which is incorporated herein by reference. Additional disclosure of conditions for forming the polymeric foams for use in the present invention are described in co-pending U.S. Provisional Patent Application Ser. No. 60/077,955, filed Mar. 13, 1998 by T. A. DesMarais, et al., titled "Abrasion Resistant Polymeric Foam And Stain Receivers Made Therefrom", the disclosure of which is incorporated herein by reference. Notwithstanding the above described preferred types of stain receivers, latex bonded air laid nonfabrics ("LBAL") and multi-bonded air laid nonfabrics ("MBAL" combined latex and thermal bonded) stain receiver may also be used.

The various stain receivers described herein, and described in the references incorporated herein by reference, preferably comprise a liquid impermeable backsheet. The backsheet can be made of, for example, a thin layer of polypropylene, polyethylene and the like. The backsheet provides protection for the surface that the stain receiver rests on from the spot cleaning composition. For example, spot cleaning processes are typically performed on a hard surface, such as a table top. The stain receiver is placed on the table and the fabric to be treated in placed on the stain receiver. Spot cleaning composition is applied to the stained area of the fabric and then drawn into the stain receiver. But in the absence of a back sheet, the spot cleaning composition can leak onto the table top, possibly causing damage thereto.

The following Examples further illustrate the invention, but are not intended to be limiting thereof.

EXAMPLE I

Cleaning and Refreshing Compositions

Fabric cleaning/refreshment compositions according to the present invention, for use in a containment bag, are prepared as follows:

| Ingredient | % (wt.) |
|---|---|
| Emulsifier (TWEEN 20)* | 0.5 |
| Perfume | 0.5 |
| KATHON ® | 0.0003 |
| Sodium Benzoate | 0.1 |
| Water | Balance |

*Polyoxyethylene (20) sorbitan monolaurate available from ICI Surfactants.

Additionally, preferred compositions for use in the in-dryer cleaning/refreshment step of the process herein are as follows.

| Ingredient | % (wt.) | Range (% wt.) |
|---|---|---|
| Water | 99.0 | 95.1–99.9 |
| Perfume | 0.5 | 0.05–1.5 |
| Surfactant | 0.5 | 0.05–2.0 |
| Ethanol or Isopropanol | 0 | Optional to 4% |
| Solvent (e.g. BPP) | 0 | Optional to 4% |

pH range from about 6 to about 8.

Additionally, preferred compositions for use in the in-dryer cleaning/refreshment step of the process herein are as follows:

| Ingredient | % (wt.) | % (wt.) | % (wt.) | % (wt.) |
|---|---|---|---|---|
| Water | 97.63 | 98.85 | 77.22 | 96.71 |
| Perfume | 0 | 0.38 | 0.38 | 0 |
| Surfactant | 0.285 | 0 | 0 | 0.285 |
| Ethanol or Isopropanol | 0 | | | |
| Solvent (e.g. BPP) | 2.0 | 0 | 0 | 2.0 |
| KATHON ® | 0.0003 | 0 | 0 | 0 |
| Emulsifier (TWEEN 20)* | 0 | 0.5 | 0.38 | 0 |
| Amine Oxide | 0.0350 | 0 | 0 | 0.0350 |
| $MgCl_2$ | 0.045 | 0 | 0 | 0 |
| $MgSO_4$ | 0 | 0 | 0.058 | 0 |
| Hydrogen Peroxide | 0 | 0 | 0 | 0.6 |
| Citric Acid | 0 | 0 | 0 | 0.05 |
| Proxel GXL | 0 | 0.08 | 0.08 | 0 |
| Bardac 2250 | 0 | 0.2 | 0.2 | 0 |
| 1,2-Propanediol | 0 | 0 | 21.75 | 0 |

*Polyoxyethylene (20) sorbitan monolaurate available from ICI Surfactants.

Besides the other ingredients, the foregoing compositions can contain enzymes to further enhance cleaning performance, as described in the Trinh et al. patent incorporated herein above.

EXAMPLE II

Preparation of a Substrate Comprising a Cleaning/Refreshment Composition

A 10¼ in.×14¼ in. (26 cm×36 cm) substrate in the form of a sheet is prepared from HYDRASPUN® material, manufactured by the Dexter Corp. The substrate sheet is covered on both sides with a topsheet and a bottomsheet of 8 mil (0.2 mm) Reemay fabric coversheet material. The coversheet (i.e., both topsheet and bottomsheet) are bonded to the substrate sheet by a Vertrod® or other standard heat sealer device, such as conventional sonic sealing devices, thereby bonding the laminate structure together around the entire periphery of the sheet. The edges of the sheet around its periphery are intercalated between the topsheet and bottomsheet by the bond. As noted above, the width of the bond is kept to a minimum and is about 0.25 in. (6.4 mm).

The bonded laminate sheet thus prepared is folded and placed in a pouch. Any plastic pouch which does not leak would be suitable. For example, a foil laminated pouch of the type used in the food service industry can be employed. Such pouches are well-known in the industry and are made from materials which do not absorb food flavors. In like manner, the formulator herein may wish to avoid absorption of the perfume used in the cleaning/refreshment composition by the pouch. Various pouches are useful herein and are commercially available on a routine basis.

The folded substrate/coversheet sheet is placed in the pouch. The folds can be of any type, for example, an accordion-style fold or rolled and then the roll is folded in half. This size is not critical but is convenient for placement in a pouch.

5 grams of a shrinkage reducing composition and 18 grams of the cleaning/refreshment composition are poured onto the substrate sheet/coversheet in any order, more preferably the shrinkage reducing composition and the cleaning/refreshment composition are mixed before pouring onto the substrate. The compositions are allowed to absorb into the substrate. The pouch is sealed immediately after the liquid product is introduced into the pouch and stored until time-of-use.

EXAMPLE III

Spot Cleaning Compositions

A spot cleaning composition for use for use in the present invention, preferably with a dispenser as defined above, and with a TBAL or poly-HIPE foam stain receiver, is prepared as follows:

| INGREDIENT | % (Wt.) (Nonionic) | Range % (Wt.) |
|---|---|---|
| Hydrogen peroxide | 1.000 | 0–2 |
| Amino tris(methylene phosphonic acid)* | 0.040 | 0–0.06 |
| Butoxypropoxypropanol (BPP) | 2.000 | 1–6 |
| Neodol 23 6.5 | 0.250 | 0–1 |
| Kathon preservative | 0.0003 | Optional** |
| Water | 96.710 | Balance |

pH target = 7;
range = 6–8
*Stabilizer for hydrogen peroxide
**Sufficient to provide a preservative function.

Another example of a preferred, high water content, low residue spot cleaning composition for use in the pre-spotting step herein is as follows.

| INGREDIENT | Anionic Composition (%) |
|---|---|
| Hydrogen peroxide | 1.000 |
| Amino tris(methylene phosphonic acid)* | 0.0400 |
| Butoxypropoxypropanol (BPP) | 2.000 |
| $NH_4$ Coconut $E_1S$ | 0.285 |
| Dodecyldimethylamine oxide | 0.031 |
| Magnesium chloride | 0.018 |
| Magnesium sulfate | 0.019 |
| Hydrotrope, perfume, other minors, | 0.101 |
| Kathon preservative | 0.0003 |
| Water (deionized or distilled) | 96.507 |
| Target pH | 6.0 |

*Stabilizer for hydrogen peroxide

Preferably, to minimize the potential for dye damage as disclosed hereinabove, $H_2O_2$-containing pre-spotting compositions comprise the anionic or nonionic surfactant in an amount (by weight of composition) which is less than the amount of $H_2O_2$. Preferably, the weight ratio of surfactant:$H_2O_2$ is in the range of about 1:10 to about 1:1.5, most preferably about 1:4 to about 1:3.

What is claimed is:

1. A vapor-venting fabric containment bag comprising:

i) an open configuration and a closed configuration;

ii) a VVE rating of at least about 40 and less than about 90, as measured in the Vapor Venting Evaluation Test; and wherein when the bag is in its closed configuration the bag comprises at least three flexible side walls and a three dimensional interior void space is formed whereby the bag resists collapsing.

2. The bag according to claim 1 which has a VVE rating of at least about 60 and less than about 90.

3. The bag according to claim 1 which has a VVE rating of at least about 60 and no greater than about 80.

4. The bag according to claim 1 which is formed from fabric which is heat resistant up to at least about 260° C.

5. The bag according to claim 1 which is formed from polyethylene terephthalate or nylon.

6. The bag according to claim 1 further comprising a first fastening device and a second fastening device, which together form a mechanical fastener.

7. The bag according to claim 1 further comprising a first fastening device and a second fastening device, which together form an adhesive fastener.

8. The bag according to claim 1 which comprises at least four side walls configured in the form of a tetrahedron.

9. The bag according to claim 1 which comprises at least six side walls configured in the form of a cube.

10. A process for cleaning or refreshing a fabric article by adding to a vapor-venting fabric containment bag according to claim 1 a fabric cleaning/refreshment composition comprising water and the fabric article to be cleaned or refreshed.

11. The process according to claim 10 which is carried out in a hot air clothes dryer at a temperature from about 40° C. to about 150° C., whereby malodors present on the fabric article are vented from the bag by means of a vapor-venting closure.

12. A kit for cleaning or refreshing a fabric article, comprising a package containing:

(a) one or more absorbent articles comprising a carrier which releasably contains water and optional non-water fabric cleaning/refreshment ingredients; and (b) a vapor-venting fabric containment bag according to claim 1.

13. The kit according to claim 12 further comprising from one to about ten of the absorbent articles which are disposable after a single use.

14. A process for cleaning or refreshing a fabric article by adding to the fabric bag of claim 1 a fabric cleaning/refreshment composition comprising water and the fabric article to be cleaned or refreshed.

15. The process according to claim 14 which is carried out in a hot air clothes dryer at a temperature from about 40° C. to about 150° C., whereby malodors present on the fabric article are vented from the bag by means of a vapor-venting closure.

16. A kit for cleaning or refreshing a fabric article, comprising a package containing:

(a) one or more absorbent articles comprising a carrier which releasably contains water and optional non-water fabric cleaning/refreshment ingredients; and (b) the fabric containment bag of claim 1.

17. The kit according to claim 16 further comprising from one to about ten of the absorbent articles which are disposable after a single use.

18. The kit according to claim 16 further comprising instructions for using the fabric bag and one or more absorbent articles to clean and/or refresh a fabric article, the instructions comprising the following steps:

(a) place the fabric article to be cleaned and/or refreshed into the fabric bag;

(b) place one or more absorbent articles into the fabric bag;

(c) place the fabric bag containing the fabric article and one or more absorbent articles into an automatic clothes dryer; and (d) operating the automatic clothes dryer such that the fabric article is cleaned and/or refreshed.

* * * * *